US007105215B2

(12) United States Patent
Sharma et al.

(10) Patent No.: US 7,105,215 B2
(45) Date of Patent: Sep. 12, 2006

(54) INK JET RECORDING ELEMENT

(75) Inventors: Krishamohan Sharma, Rochester, NY (US); Joseph F. Bringley, Rochester, NY (US); Paul B. Merkel, Victor, NY (US); Deepak Shukla, Webster, NY (US); Christine Landry-Coltrain, Fairport, NY (US)

(73) Assignee: Eastman Kodak Company, Rochester, NY (US)

( * ) Notice: Subject to any disclaimer, the term of this patent is extended or adjusted under 35 U.S.C. 154(b) by 390 days.

(21) Appl. No.: 10/180,638

(22) Filed: Jun. 26, 2002

(65) Prior Publication Data

US 2004/0202831 A1 Oct. 14, 2004

(51) Int. Cl.
*B41M 5/00* (2006.01)

(52) U.S. Cl. ..... 428/32.15; 428/32.34

(58) Field of Classification Search ..... 428/32.34, 428/32.15, 32.14; 347/105
See application file for complete search history.

(56) References Cited

U.S. PATENT DOCUMENTS 5,372,884 A 12/1994 Abe et al.
5,500,668 A * 3/1996 Malhotra et al. ..... 347/105
5,686,602 A * 11/1997 Farooq et al. ..... 536/101
6,506,478 B1 * 1/2003 Schulz ..... 544/58.5
6,780,478 B1 * 8/2004 Steiger et al. ..... 428/32.32
2005/0013945 A1 * 1/2005 Bringley et al. ..... 428/32.34
2005/0014000 A1 * 1/2005 Bringley et al. ..... 428/403

FOREIGN PATENT DOCUMENTS

| | | |
|---|---|---|
| EP | 0391308 | 4/1990 |
| EP | 0 965 460 A2 | 12/1999 |
| EP | 0963947 | 12/1999 |
| EP | 1 016 543 A1 | 7/2000 |
| EP | 1112962 | 7/2001 |
| JP | 04007189 | 1/1992 |
| JP | 10226153 | 8/1998 |

* cited by examiner

*Primary Examiner*—Pamela R. Schwartz
(74) *Attorney, Agent, or Firm*—Harold E. Cole; Chris P. Konkol

(57) ABSTRACT

An ink jet recording element comprising a support having thereon an image-receiving layer, the ink jet recording element containing a metal(oxy)hydroxide complex, $M^{n+}(O)_a(OH)_b(A^{p-})_c \cdot xH_2O$, wherein M is at least one metal ion; n is 3 or 4; A is an organic or inorganic ion; p is 1, 2 or 3; and x is equal to or greater than 0; with the proviso that when n is 3, then a, b and c each comprise a rational number as follows: $0 \leqq a < 1.5$; $0 < b < 3$; and $0 \leqq pc < 3$, so that the charge of the $M^{3+}$ metal ion is balanced; and when n is 4, then a, b and c each comprise a rational number as follows: $0 \leqq a < 2$; $0 < b < 4$; and $0 \leqq pc < 4$, so that the charge of the $M^{4+}$ metal ion is balanced.

16 Claims, No Drawings

INK JET RECORDING ELEMENT

CROSS REFERENCE TO RELATED APPLICATIONS

Reference is made to commonly assigned, co-pending U.S. patent applications:

Ser. No. 10/180,373 by Sharma et al., filed of even date herewith entitled "Ink Jet Recording Element";

Ser. No. 10/180,752 by sharma et al., filed of even date herewith entitled "ink Jet Recording Element";

Ser. No. 10/180,184 by Bringley et al., filed of even date herewith entitled "Ink Jet Printing Method";

Ser. No. 10/180,182 by Sharma et al., filed of even date herewith entitled "Ink Jet Recording Method";

Ser. No. 10/180,187 by Bringley et al., filed of even date herewith entitled "Ink Jet Printing Method" now U.S. Pat. No. 6,984,033;

Ser. No. 10/180,395 by Bringley et al., filed of even date herewith entitled "Ink let Printing Method" now U.S. Pat. No. 6,991,835; and Ser. No. 10/180,179 by Bringley et al., filed of even date herewith entitled "Ink Jet Recording Element".

FIELD OF THE INVENTION

The present invention relates to an ink jet recording element containing a stabilizer.

BACKGROUND OF THE INVENTION

In a typical ink jet recording or printing system, ink droplets are ejected from a nozzle at high speed towards a recording element or medium to produce an image on the medium. The ink droplets, or recording liquid, generally comprise a recording agent, such as a dye or pigment, and a large amount of solvent. The solvent, or carrier liquid, typically is made up of water and an organic material such as a monohydric alcohol, a polyhydric alcohol or mixtures thereof.

An ink jet recording element typically comprises a support having on at least one surface thereof an ink-receiving or image-receiving layer, and includes those intended for reflection viewing, which have an opaque support, and those intended for viewing by transmitted light, which have a transparent support.

An important characteristic of ink jet recording elements is their need to dry quickly after printing. To this end, porous recording elements have been developed which provide nearly instantaneous drying as long as they have sufficient thickness and pore volume to effectively contain the liquid ink. For example, a porous recording element can be manufactured by coating in which a particulate-containing coating is applied to a support and is dried.

When a porous recording element is printed with dye-based inks, the dye molecules penetrate the coating layers. However, there is a problem with such porous recording elements in that the optical densities of images printed thereon are lower than one would like. The lower optical densities are believed to be due to optical scatter which occurs when the dye molecules penetrate too far into the porous layer. Another problem with a porous recording element is that atmospheric gases or other pollutant gases readily penetrate the element and lower the optical density of the printed image causing it to fade.

EP 1 016 543 relates to an ink jet recording element containing aluminum hydroxide in the form of boehmite.

However, there is a problem with this element in that it is not stable to light and exposure to atmospheric gases.

EP 0 965 460A2 relates to an ink jet recording element containing aluminum hydrate having a boehmite structure and a non-coupling zirconium compound. However, there is no specific teaching of a metal oxy(hydroxide) complex as described herein.

U.S. Pat. No. 5,372,884 relates to ink jet recording elements containing a hydrous zirconium oxide. However, there is a problem with such elements in that they tend to fade when subjected to atmospheric gases, as will be shown hereafter.

It is an object of this invention to provide an ink jet recording element that, when printed with dye-based inks, provides superior optical densities, good image quality and has an excellent dry time.

SUMMARY OF THE INVENTION

This and other objects are achieved in accordance with the invention which comprises an ink jet recording element comprising a support having thereon an image-receiving layer, the ink jet recording element containing a metal(oxy) hydroxide complex, $$M^{n+}(O)_a(OH)_b(A^{p-})_c \cdot xH_2O,$$

wherein

M is at least one metal ion;

n is 3 or 4;

A is an organic or inorganic ion;

p is 1, 2 or 3; and x is equal to or greater than 0;

with the proviso that when n is 3, then a, b and c each comprise a rational number as follows: $0 \leqq a < 1.5$; $0 < b < 3$; and $0 \leqq pc < 3$, so that the charge of the $M^{3+}$ metal ion is balanced;

and when n is 4, then a, b and c each comprise a rational number as follows: $0 \leqq a < 2$; $0 < b < 4$; and $0 \leqq pc < 4$, so that the charge of the $M^{4+}$ metal ion is balanced.

By use of the invention, an ink jet recording element is obtained that, when printed with dye-based inks, provides superior optical densities, good image quality and has an excellent dry time.

DETAILED DESCRIPTION OF THE INVENTION

In a preferred embodiment of the invention, the stabilizer complex described above is located in the image-receiving layer. In another preferred embodiment, M in the above formula is a Group IIIA, IIIB, IVA, IVB metal or a lanthanide group metal of the periodic chart, such as tin, titanium, zirconium, aluminum, silica, yttrium, cerium or lanthanum or mixtures thereof. In another preferred embodiment, the stabilizer described above is in a particulate form or is in an amorphous form. In another preferred embodiment, n is 4; a, b and c each comprise a rational number as follows: $0 \leqq a < 1$; $1 < b < 4$; and $1 \leqq pc < 4$, so that the charge of the $M^{4+}$ metal ion is balanced. In still another preferred embodiment, a is 0, n is 4, and b+pc is 4. In yet still another preferred embodiment, a is 0, n is 3, and b+pc is 3.

In yet still another preferred embodiment of the invention, $A^{p-}$ is an organic anion such as R—$COO^-$, R—$O^-$, R—$SO_3^-$, R—$OSO_3^-$ or R—O—$PO_3^-$ where R is an alkyl or aryl group. In another preferred embodiment, $A^{p-}$ is an inorganic anionic such as $I^-$, $Cl^-$, $Br^-$, $F^-$, $ClO_4^-$, $NO_3^-$, $CO_3^{2-}$ or $SO_4^{2-}$. The particle size of the complex described above is less than about 1 μm, preferably less than about 0.1 μm.

Metal (oxy)hydroxide complexes employed herein may be prepared by dissolving a metal salt in water and adjusting the concentration, pH, time and temperature to induce the precipitation of metal (oxy)hydroxide tetramers, polymers or particulates. The conditions for precipitation vary depending upon the nature and concentrations of the counter ion(s) present and can be determined by one skilled in the art. For example, soluble complexes suitable for preparation of the zirconium (oxy)hydroxide particulates include, but are not limited to, $ZrOCl_2$ $8H_2O$, and the halide, nitrate, acetate, sulfate, carbonate, propionate, acetylacetonate, citrate and benzoate salts; and hydroxy salts with any of the above anions. It is also possible to prepare the complexes employed in the invention via the hydrolysis of organically soluble zirconium complexes such as zirconium alkoxides, e.g., zirconium propoxide, zirconium isopropoxide, zirconium ethoxide and related organometallic zirconium compounds.

The hydrolyzed zirconium oxyhydroxides, $$Zr(O)_a(OH)_b(A^{P-})_c{*}xH_2O$$

may exist as tetrameric zirconia units or as polymeric complexes of tetrameric zirconia, wherein zirconium cations are bridged by hydroxy and/or oxo groups. In general, hydrolyzed zirconia salts are amorphous and may exist predominantly in the β form. However, depending upon the experimental conditions (solvents, pH, additives, aging and heating conditions), the hydrolyzed product may contain significant number of "oxo" bridges.

It is often difficult to ascertain the precise composition of "oxo" and "hydroxy" groups in hydrolyzed metal salts. Therefore, the usage of definitive numbers for these functional groups in metal (oxy)hydroxide compositions was avoided. Any number of oligomeric or polymeric units of metal complexes may be condensed via hydrolysis reactions to form larger particulates ranging in size from about 3 nm to 500 nm.

It is further possible to age or heat treat suspensions of the complexes to obtain particulates ranging in size from about 0.500 μm to 5.0 μm. Preferred particles sizes are in the range from about 5 nm to 1000 nm. Calcination of amorphous metal (oxy)hydroxide leads to the formation of crystalline polymorphs of metal oxides.

In a preferred embodiment of the invention, the image-receiving layer is porous and also contains a polymeric binder in an amount insufficient to alter the porosity of the porous receiving layer. In another preferred embodiment, the polymeric binder is a hydrophilic polymer such as poly (vinyl alcohol), poly(vinyl pyrrolidone), gelatin, cellulose ethers, poly(oxazolines), poly(vinylacetamides), partially hydrolyzed poly(vinyl acetate/vinyl alcohol), poly(acrylic acid), poly(acrylamide), poly(alkylene oxide), sulfonated or phosphated polyesters and polystyrenes, casein, zein, albumin, chitin, chitosan, dextran, pectin, collagen derivatives, collodian, agar-agar, arrowroot, guar, carrageenan, tragacanth, xanthan, rhamsan and the like. In still another preferred embodiment of the invention, the hydrophilic polymer is poly(vinyl alcohol), hydroxypropyl cellulose, hydroxypropyl methyl cellulose, or a poly(alkylene oxide). In yet still another preferred embodiment, the hydrophilic binder is poly(vinyl alcohol).

In addition to the image-receiving layer, the recording element may also contain a base layer, next to the support, the function of which is to absorb the solvent from the ink. Materials useful for this layer include particles, polymeric binder and/or crosslinker.

The support for the ink jet recording element used in the invention can be any of those usually used for ink jet receivers, such as resin-coated paper, paper, polyesters, or microporous materials such as polyethylene polymer-containing material sold by PPG Industries, Inc., Pittsburgh, Pa. under the trade name of Teslin®, Tyvek® synthetic paper (DuPont Corp.), and OPPalyte® films (Mobil Chemical Co.) and other composite films listed in U.S. Pat. No. 5,244,861. Opaque supports include plain paper, coated paper, synthetic paper, photographic paper support, melt-extrusion-coated paper, and laminated paper, such as biaxially oriented support laminates. Biaxially oriented support laminates are described in U.S. Pat. Nos. 5,853,965; 5,866,282; 5,874,205; 5,888,643; 5,888,681; 5,888,683; and 5,888,714, the disclosures of which are hereby incorporated by reference. These biaxially oriented supports include a paper base and a biaxially oriented polyolefin sheet, typically polypropylene, laminated to one or both sides of the paper base. Transparent supports included glass, cellulose derivatives, e.g., a cellulose ester, cellulose triacetate, cellulose diacetate, cellulose acetate propionate, cellulose acetate butyrate; polyesters, such as poly(ethylene terephthalate), poly(ethylene naphthalate), poly(1,4-cyclohexanedimethylene terephthalate), poly(butylene terephthalate), and copolymers thereof; polyimides; polyamides; polycarbonates; polystyrene; polyolefins, such as polyethylene or polypropylene; polysulfones; polyacrylates; polyetherimides; and mixtures thereof. The papers listed above include a broad range of papers, from high end papers, such as photographic paper to low end papers, such as newsprint. In a preferred embodiment, polyethylene-coated paper is employed.

The support used in the invention may have a thickness of from about 50 to about 500 μm, preferably from about 75 to 300 μm. Antioxidants, antistatic agents, plasticizers and other known additives may be incorporated into the support, if desired.

In order to improve the adhesion of the ink-receiving layer to the support, the surface of the support may be subjected to a corona-discharge treatment prior to applying the image-receiving layer.

Coating compositions employed in the invention may be applied by any number of well known techniques, including dip-coating, wound-wire rod coating, doctor blade coating, gravure and reverse-roll coating, slide coating, bead coating, extrusion coating, curtain coating and the like. Known coating and drying methods are described in further detail in Research Disclosure no. 308119, published December 1989, pages 1007 to 1008. Slide coating is preferred, in which the base layers and overcoat may be simultaneously applied. After coating, the layers are generally dried by simple evaporation, which may be accelerated by known techniques such as convection heating.

In order to impart mechanical durability to an ink jet recording element, crosslinkers which act upon the binder discussed above may be added in small quantities. Such an additive improves the cohesive strength of the layer. Crosslinkers such as carbodiimides, polyfunctional aziridines, aldehydes, isocyanates, epoxides, polyvalent metal cations, and the like may all be used.

To improve colorant fade, UV absorbers, radical quenchers or antioxidants may also be added to the image-receiving layer as is well known in the art. Other additives include inorganic or organic particles, pH modifiers, adhesion promoters, rheology modifiers, surfactants, biocides, lubricants, dyes, optical brighteners, matte agents, antistatic agents, etc. In order to obtain adequate coatability, additives known to those familiar with such art such as surfactants, defoamers, alcohol and the like may be used. A common level for coating aids is 0.01 to 0.30% active coating aid based on the total solution weight. These coating aids can be nonionic, anionic, cationic or amphoteric. Specific elements are described in MCCUTCHEON's Volume 1: Emulsifiers and Detergents, 1995, North American Edition.

The ink receiving layer employed in the invention can contain one or more mordanting species or polymers. The mordant polymer can be a soluble polymer, a charged molecule, or a crosslinked dispersed microparticle. The mordant can be non-ionic, cationic or anionic.

The coating composition can be coated either from water or organic solvents, however water is preferred. The total solids content should be selected to yield a useful coating thickness in the most economical way, and for particulate coating formulations, solids contents from 10–40% are typical.

Ink jet inks used to image the recording elements of the present invention are well-known in the art. The ink compositions used in ink jet printing typically are liquid compositions comprising a solvent or carrier liquid, dyes or pigments, humectants, organic solvents, detergents, thickeners, preservatives, and the like. The solvent or carrier liquid can be solely water or can be water mixed with other water-miscible solvents such as polyhydric alcohols. Inks in which organic materials such as polyhydric alcohols are the predominant carrier or solvent liquid may also be used. Particularly useful are mixed solvents of water and polyhydric alcohols. The dyes used in such compositions are typically water-soluble direct or acid type dyes. Such liquid compositions have been described extensively in the prior art including, for example, U.S. Pat. Nos. 4,381,946; 4,239,543 and 4,781,758, the disclosures of which are hereby incorporated by reference.

Although the recording elements disclosed herein have been referred to primarily as being useful for ink jet printers, they also can be used as recording media for pen plotter assemblies. Pen plotters operate by writing directly on the surface of a recording medium using a pen consisting of a bundle of capillary tubes in contact with an ink reservoir.

The following examples are provided to illustrate the invention.

EXAMPLES

Example 1

Dye Stability Evaluation Tests

The dye used for testing was a magenta colored ink jet dye having the structure shown below. To assess dye stability on a given substrate, a measured amount of the ink jet dye and solid particulates or aqueous colloidal dispersions of solid particulates (typically about 10%–20.0% by weight solids) were added to a known amount of water such that the concentration of the dye was about $10^{-5}$ M. The solid dispersions containing dyes were carefully stirred and then spin coated onto a glass substrate at a speed of 1000–2000 rev/min. The spin coatings obtained were left in ambient atmosphere with fluorescent room lighting (about 0.5 Klux) kept on at all times during the measurement. The fade time was estimated by noting the time required for complete disappearance of magenta color as observed by the naked eye or by noting the time required for the optical absorption to decay to less than 0.03 of the original value.

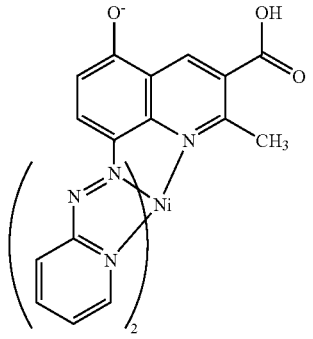

Magenta Dye

Comparative Coatings C-1 to C-13 (Non-metal(oxy)hydroxide salts)

Inorganic particles of $Al_2O_3$, $SiO_2$, $TiO_2$, ZnO, MgO, $ZrO_2$, $Y_2O_3$, $CeO_2$, $CaCO_3$, $BaSO_4$, $Zn(OH)_2$, laponite and montmorillonite were purchased from commercial sources as fine particles or as colloidal particulate dispersions and were used to evaluate the stability of ink jet dyes in comparison with the materials employed in the present invention. The compositions and chemical identity of the samples was confirmed using powder X-ray diffraction techniques. The particulates were then coated and tested as described above.

Inventive Coatings I-1 to I-16

I-1. To a 5.0 g of 1M solution of $Al(NO_3)_3 \cdot 6H_2O$, 6.3 g of an approximately 2.9% aqueous ammonia solution was added at room temperature with stirring. The resultant colloidal dispersion with pH about 5.5 was then coated and tested as described above and the results shown in Table 1 below.

I-2. To a 4.8 g of 1M solution of $AlCl_3 \cdot 6H_2O$, 10.2 g of a 1 M sodium hydroxide was added at room temperature with stirring. The resultant colloidal dispersion with pH=4.7 was then coated and tested as described above and the results shown in Table 1 below.

I-3. To a 5.0 g of 0.25 M solution of $CeCl_3$, 2.4 ml of a 0.2M sodium hydroxide was added at room temperature with stirring. The resultant colloidal dispersion with pH=7.3 was then coated and tested as described above and the results shown in Table 1 below.

I-4. To a 5.0 g of 0.25 M solution of $Ce(CH_3COO)_3 \cdot xH_2O$, 1.1 ml of a 0.2M sodium hydroxide was added slowly at room temperature, while stirring the reaction mixture. The resultant colloidal dispersion with pH=7.5 was then coated and tested as described above and the results shown in Table 1 below.

I-5. To a 5.0 g of 0.5 M solution of $Ce(NO_3)_3 \cdot xH_2O$, 0.8 ml of a 0.2M sodium hydroxide solution was added slowly at room temperature, while stirring the reaction mixture. The resultant colloidal dispersion with pH 7.0 was then coated and tested as described above and the results shown in Table 1 below.

I-6. To a 5.0 g of 0.25 M solution of $La(CH_3COO)_3 \cdot xH_2O$, 0.12 ml of a 0.2M sodium hydroxide solution was added slowly at room temperature, while stirring the reaction mixture. The resultant colloidal dispersion with pH=7.6 was then coated and tested as described above and the results shown in Table 1 below.

I-7. To a 5.0 g of 0.5 M solution of $La(NO_3)_3 \cdot xH_2O$, 0.8 ml of a 0.2M sodium hydroxide solution was added slowly at room temperature, while stirring the reaction mixture. The resultant colloidal dispersion with pH=7.7 was then coated and tested as described above and the results shown in Table 1 below.

I-8. To a 5.0 g of 0.5 M solution of $YCl_3 \cdot 6H_2O$, 0.7 ml of a 2.8–3.0% ammonia solution was added slowly at room temperature, while stirring the reaction mixture. The resultant colloidal dispersion with pH=6.6 was then coated and tested as described above and the results shown in Table 1 below.

I-9. To a 5.0 g of 0.5 M solution of $Y(NO)_3 \cdot 6H_2O$, 3.1 ml of a 0.1M sodium hydroxide solution was added slowly at room temperature, while stirring the reaction mixture. The resultant colloidal dispersion with pH=6.4 was then coated and tested as described above and the results shown in Table 1 below.

I-10. To a 5.0 g of 0.25 M solution of $Y(CH_3COO)_3 \cdot xH_2O$, 1.5 ml of a 2.8–3.0% solution of ammonia hydroxide was added slowly at room temperature, while stirring the reaction mixture. The resultant colloidal dispersion with pH=9.6 was then coated and tested as described above and the results shown in Table 1 below.

I-11. To a 5.0 g of 0.25 M solution of $Gd(CH_3COO)_3 \cdot xH_2O$, 3.5 ml of a 0.2M sodium hydroxide solution was added slowly at room temperature, while stirring the reaction mixture. The resultant colloidal dispersion with pH=7.5 was then coated and tested as described above and the results shown in Table 1 below.

I-12. To a 5.0 g of 0.25 M solution of $Sm(CH_3COO)_3 \cdot xH_2O$, 3.7 ml of a 0.2M sodium hydroxide solution was added slowly at room temperature, while stirring the reaction mixture. The resultant colloidal dispersion with pH=7.5 was then coated and tested as described above and the results shown in Table 1 below.

I-13. A 10% colloidal dispersion of zirconium(iv)acetate hydroxide was made by adding 1.0 g of the salt in 9 ml of distilled water at room temperature. The resultant dispersion with pH ca. 4.1 was then coated and tested as described above and the results shown in Table 1 below.

I-14. To a 10.0 ml solution of 1M $ZrOCl_2.8H_2O$, 8.3 ml of 1M sodium acetate was gradually added and vigorously stirred at room temperature. The final colloidal dispersion with (ca. 14% solids) pH ca. 3.0 was then coated and tested as described above and the results shown in Table 1 below.

I-15. To a 10.0 ml solution of 0.5 M $ZrOCl_2.8H_2O$, 1.7 ml of 0.5 M sodium hydroxide was gradually added while vigorously stirring at room temperature. The resultant colloidal dispersion (ca. 19% solids) with pH 3.6 was then coated and tested as described above and the results shown in Table 1 below.

I-16. To a 5.0 ml of 20% solution of $Si(CH_3COO)_4$, 4.6 ml of 1M sodium hydroxide was gradually added while vigorously stirring at room temperature. The resultant colloidal dispersion with pH 4.8 was then coated and tested as described above and the results shown in Table 1 below.

TABLE 1

| Coating | Particle | Fade Time | Hue Change |
|---|---|---|---|
| C-1 | $Al_2O_3$ | 18 hours | No |
| C-2 | $SiO_2$ | 18 hours | No |
| C-3 | $TiO_2$ | 18 hours | No |
| C-4 | ZnO | 2 days | No |

TABLE 1-continued

| Coating | Particle | Fade Time | Hue Change |
|---|---|---|---|
| C-5 | MgO | 18 hours | No |
| C-6 | $ZrO_2$ | 18 hours | No |
| C-7 | $Y_2O_3$ | 7 days | No |
| C-8 | $CeO_2$ | 7 days | No |
| C-9 | $CaCO_3$ | 5 days | Yes |
| C-10 | $BaSO_4$ | 6 days | Yes |
| C-11 | $Zn(OH)_2$ | 5 days | Yes |
| C-12 | Laponite | 4 days | No |
| C-13 | Montmorillonite | 18 hours | Yes |
| I-1 | $Al(O)_a(OH)_b(NO_3)_c.xH_2O$ | >30 days | No |
| I-2 | $Al(O)_a(OH)_b(Cl)_c.xH_2O$ | >30 days | No |
| I-3 | $Ce(O)_a(OH)_b(Cl)_c.xH_2O$ | >30 days | No |
| I-4 | $Ce(O)_a(OH)_b(CH_3COO)_c.xH_2O$ | >30 days | No |
| I-5 | $Ce(O)_a(OH)_b(NO_3)_c.xH_2O$ | >30 days | No |
| I-6 | $La(O)_a(OH)_b(CH_3COO)_c.xH_2O$ | >30 days | No |
| I-7 | $La(O)_a(OH)_b(NO_3)_c.xH_2O$ | >30 days | No |
| I-8 | $Y(O)_a(OH)_b(Cl)_c.xH_2O$ | >30 days | No |
| I-9 | $Y(O)_a(OH)_b(NO_3)_c.xH_2O$ | >30 days | No |
| I-10 | $Y(O)_a(OH)_b(CH_3COO)_c.xH_2O$ | >30 days | No |
| I-11 | $Gd(O)_a(OH)_b(CH_3COO)_c.xH_2O$ | >30 days | No |
| I-12 | $Sm(O)_a(OH)_b(CH_3COO)_c.xH_2O$ | >30 days | No |
| I-13 | $Zr(OH)_b(CH_3COO)_c(H_2O)_{b+c-4}$ | >30 days | No |
| I-14 | $Zr(O)_a(OH)_b(CH_3CH_2COO)_{0.83}.(Cl)_{1.17}H_2O$ | >30 days | No |
| I-15 | $Zr(O)_a(OH)_b(Cl)_{1.83}H_2O$ | >30 days | No |
| 1-16 | $Si(O)_a(OH)_b(CH_3COO)_c.xH_2O$ | >30 days | No |

The above results show that the complexes employed in the present invention provide superior image stability and stabilize the ink jet dye against fade and hue changes, particularly when compared to the control materials. The above results further show that the materials employed in the present invention can be prepared from various three and four valent metal ions, and from an assortment of inorganic and organic anions.

Example 2

Coatings were made and tested as in Example 1 using the materials described below. The results are shown in Table 2 below.

Comparative Coatings C-14 to C-18 (Non-metal(oxy)hydroxide salts)

Metal oxides, $Al_2O_3$, $SiO_2$, $TiO_2$, ZnO and $ZrO_2$, were purchased from commercial sources as nanoparticulate colloidal dispersions and were used to evaluate the stability of inkjet dyes in comparison with zirconium (oxy)hydroxides employed in the present invention. The particle size of the commercial colloids was typically in the range from 50–500 nm. The pH of the colloids varied as shown in Table 2 below.

Inventive Coatings I-17 to I-37

I-17: $Zr(OH)_b(CH_3COO)_c$: A 10% solution of zirconium (iv)acetate hydroxide was made by dissolving 1.0 g of the salt in 9 ml of distilled water at room temperature. The final dispersion with pH ca. 4.1 was used for evaluating the stability of ink jet dyes as described above.

I-18. The composition of OH groups in I-17 was increased by the addition of 0.7 ml of 0.5 M NaOH to 10 ml of 10% 1–17. The final dispersion with pH ca. 6.7 was used for evaluating the stability of ink jet dyes as described above.

I-19: The composition of OH groups in I-17 was further increased by the addition of 1.1 ml of 0.5 M NaOH to 10 ml of 10% I-17. The final dispersion with pH ca. 9.0 was used for evaluating the stability of inkjet dyes as described above.

I-20: In order to enhance the composition of acetate groups in I-17 (i.e. with lower pH), zirconium acetate solution (ca. 16%) in dilute acetic acid with pH 3.0 was used to evaluate the stability of ink jet dyes as described above.

I-21: $Zr(O)_a(OH)_b(CH_3COO)_{0.83}\bullet(Cl)_{1.17}\bullet xH_2O$: To a 10.0 ml solution of 1M $ZrOCl_2.8H_2O$, 8.3 ml of 1M sodium acetate was gradually added and vigorously stirred at room temperature. The final colloidal dispersion with pH ca. 3.0 was used for evaluating the stability of the ink jet dyes as described above.

I-22: $Zr(O)_a(OH)_b(CH_3COO)\bullet(Cl)\bullet xH_2O$: To a 10.0 ml solution of 1M $ZrOCl_2.8H_2O$, 10.0 ml of, M sodium acetate was gradually added and vigorously stirred at room temperature. The final colloidal dispersion with pH around 4.0 was used for evaluating the stability of the ink jet dyes as described above.

I-23: $Zr(O)_a(OH)_b(CH_3COO)_{2.5}\bullet xH_2O$: To a 10.0 ml solution of 1M $ZrOCl_2.8H_2O$, 25.0 ml of 1M sodium acetate was gradually added while vigorously stirring at room temperature. The resultant thick gel like colloidal dispersion with pH 5.5 was used for evaluating the stability of the ink jet dyes as described above.

I-24: $Zr(O)_a(OH)_b(CH_3CH_2COO)_{1.5}\bullet(Cl)_{0.5}\bullet xH_2O$: To a 10.0 ml solution of 1M $ZrOCl_2.8H_2O$, 15.0 ml of 1M sodium propionate was gradually added, while vigorously stirring at room temperature. The resultant colloidal dispersion with pH 3.25 was used for evaluating the stability of the ink jet dyes as described above.

I-25: $Zr(O)_a(OH)_b(CH_3CH_2COO)_{3.0}\bullet xH_2O$: To a 10.0 ml solution of 1M $ZrOCl_2.8H_2O$, 30.0 ml of 1M sodium propionate was gradually added while vigorously stirring at room temperature. The resultant colloidal dispersion with pH 5.2 was used for evaluating the stability of the ink jet dyes as described above. A small amount of chloride anions may also bind to zirconium (oxy)hydroxides.

I-26: $Zr(O)_a(OH)_b(C_6H_5COO)_{1.75}\bullet(Cl)_{0.25}\bullet xH_2O$: To a 10.0 ml solution of 1M $ZrOCl_2.8H_2O$, 35.0 ml of 0.5 M sodium benzoate was gradually added, while vigorously stirring at room temperature. The resultant thick gel like colloidal dispersion with pH 3.3 was used for evaluating the stability of the ink jet dyes as described above.

I-27: $Zr(O)_a(OH)_b(C_6H_5COO)_{2.5}\bullet xH_2O$: To a 10.0 ml solution of 1M $ZrOCl_2.8H_2O$, 50.0 ml of 0.5 M sodium benzoate was gradually added while vigorously stirring at room temperature. The resultant thick gel like colloidal dispersion with pH 5.4 was used for evaluating the stability of the ink jet dyes as described above. A small amount of chloride anions may also bind to zirconium (oxy)hydroxides.

I-28: $Zr(O)_a(OH)_b(Cl)_{1.83}\bullet H_2O$: To a 10.0 ml solution of 0.5 M $ZrOCl_2.8H_2O$, 1.7 ml of 0.5 M sodium hydroxide was gradually added while vigorously stirring at room temperature. The resultant colloidal dispersion with pH 3.6 was used for evaluating the stability of the ink jet dyes as described above.

I-29: $Zr(O)_a(OH)_b(Cl)_{1.79}\bullet xH_2O$: To a 10.0 ml solution of 0.5 M $ZrOCl_2.8H_2O$, 2.1 ml of 0.5 M sodium hydroxide was gradually added while vigorously stirring at room temperature. The resultant colloidal dispersion with pH 6.1 was used for evaluating the stability of the ink jet dyes as described above.

I-30: $Zr(O)_a(OH)_b(Cl)_c\bullet xH_2O$: To a 10.0 ml solution of 0.5 M $ZrOCl_2.8H_2O$, 5.0 ml of 0.5 M sodium hydroxide was gradually added while vigorously stirring at room temperature. The resultant colloidal dispersion with pH 12.9 was used for evaluating the stability of the ink jet dyes as described above. Above pH 7.0, the composition of OH groups in zirconium complexes may dominate due to base hydrolysis and a small percentage of chloride anions may bind to zirconium (oxy)hydroxides.

I-31: $Zr(O)_a(OH)_b(CO_3)_{0.7}(Cl)_{1.3}\bullet xH_2O$: To a 10.0 ml solution of 1 M $ZrOCl_2.8H_2O$, 7.0 ml of 1 M sodium carbonate was gradually added while vigorously stirring at room temperature. The resultant colloidal dispersion with pH 3.4 was used for evaluating the stability of the inkjet dyes as described above.

I-32: $Zr(O)_a(OH)_b(CO_3)_c(Cl)_d\bullet xH_2O$: To a 10.0 ml solution of 1 M $ZrOCl_2.8H_2O$, 15.0 ml of 1 M sodium carbonate was gradually added while vigorously stirring at room temperature. The resultant colloidal dispersion with pH 7.7 was used for evaluating the stability of the ink jet dyes as described above. Above pH 7.0, the composition of OH groups in zirconium complexes may dominate due to base hydrolysis and a small percentage of "carbonate" and "chloride" anions may bind to zirconium (oxy)hydroxides.

I-33: $Zr(O)_a(OH)_b(NO_3)_{1.87}\bullet xH_2O$: To a 10.0 ml solution of 0.5 M $ZrO(NO_3)_2.xH_2O$, 1.3 ml of 0.5 M sodium hydroxide was gradually added while vigorously stirring at room temperature. The resultant colloidal dispersion with pH 3.0 was used for evaluating the stability of the ink jet dyes as described above.

I-34: $Zr(O)_a(OH)_b(NO_3)_c\bullet nH_2O$: To a 10.0 ml solution of 0.5 M $ZrO(NO_3)_2.xH_2O$, 2.2 ml of 0.5 M NaOH was gradually added while vigorously stirring at room temperature. The resultant colloidal dispersion with pH 11.3 was used for evaluating the stability of the ink jet dyes as described above. Above pH 7.0, the composition of OH groups in zirconium complexes may dominate due to base hydrolysis and a small percentage of nitrate anions may bind to the polycationic complexes of zirconium (oxy)hydroxides.

I-35: $Zr(O)_a(OH)_b(NO_3)_{1.52}(CO_3)_{0.48}\bullet nH_2O$: To a 10.0 ml solution of 0.5 M $ZrO(NO_3)_2.xH_2O$, 2.4 ml of 1 M sodium carbonate was gradually added while vigorously stirring at room temperature. The resultant colloidal dispersion with pH 3.1 was used for evaluating the stability of the ink jet dyes as described above.

I-36: $Zr(O)_a(OH)_b(NO_3)_c(CO_3)_d\bullet nH_2O$: To a 10.0 ml solution of 0.5 M $ZrO(NO_3)_2.xH_2O$, 6.0 ml of 1 M sodium carbonate was gradually added while vigorously stirring at room temperature. The resultant colloidal dispersion with pH 9.2 was used for evaluating the stability of the ink jet dyes as described above.

I-37: $Zr(OH)_4$: A 10% solution of zirconium(iv)hydroxide was made by dissolving 1.0 g of $Zr(OH)_4$ in 9 ml of distilled water at room temperature. The resultant solution with pH 7.9 was used for evaluating the stability of the ink jet dyes as described above.

TABLE 2

| Coating | Particle | Fade Time | Hue Change |
|---|---|---|---|
| C-14 | $Al_2O_3$ | 18 hours | No |
| C-15 | $ZrO_2$ | 24 hours | No |
| C-16 | $SiO_2$ | 18 hours | No |
| C-17 | ZnO | 2 days | No |
| C-18 | $TiO_2$ | 18 hours | No |
| I-17 | $Zr(OH)_b(CH_3COO)_c.xH_2O_{,b+c=4}$ | >30 days | No |
| I-18 | $Zr(OH)_b(CH_3COO)_c.xH_2O_{,b+c=4,b>c}$ | >30 days | No |
| I-19 | $Zr(OH)_b(CH_3COO)_c.xH_2O_{,b+c=4,b>>c}$ | >30 days | Yes |
| I-20 | $Zr(OH)_b(CH_3COO)_c.xH_2O_{,b+c=4,b<c}$ | >30 days | No |
| I-21 | $Zr(O)_a(OH)_b(CH_3COO)_{0.83}.(Cl)_{1.17}.xH_2O$ | >30 days | No |
| I-22 | $Zr(O)_a(OH)_b(CH_3COO).(Cl).xH_2O$ | >30 days | No |

TABLE 2-continued

| Coating | Particle | Fade Time | Hue Change |
|---|---|---|---|
| I237 | $Zr(O)_a(OH)_b(CH_3COO)_{2.5}.xH_2O$ | >30 days | No |
| I-24 | $Zr(O)_a(OH)_b(CH_3CH_2COO)_{1.5}.(Cl)_{0.5}.xH_2O$ | >30 days | No |
| I-25 | $Zr(O)_a(OH)_b(CH_3CH_2COO)_{3.0}.xH_2O$ | >30 days | No |
| I-26 | $Zr(O)_a(OH)_b(C_6H_5COO)_{1.75}.(Cl)_{0.25}.xH_2O$ | >25 days | No |
| I-27 | $Zr(O)_a(OH)_b(C_6H_5COO)_{2.5}.xH_2O$ | >25 days | No |
| I-28 | $Zr(O)_a(OH)_b(Cl)_{1.83}.xH_2O$ | >30 days | No |
| I-29 | $Zr(O)_a(OH)_b(Cl)_{1.79}.xH_2O$ | >30 days | No |
| I-30 | $Zr(O)_a(OH)_b(Cl)_c.xH_2O$ | >30 days | Yes |
| I-31 | $Zr(O)_a(OH)_b(CO_3)_{0.7}(Cl)_{1.3}.xH_2O$ | >30 days | No |
| I-32 | $Zr(O)_a(OH)_b(CO_3)_c(Cl)_d.xH_2O$ | >30 days | Yes |
| I-33 | $Zr(O)_a(OH)_b(NO_3)_{1.87}.xH_2O$ | >30 days | No |
| I-34 | $Zr(O)_a(OH)_b(NO_3)_c.xH_2O$ | >30 days | Yes |
| I-35 | $Zr(O)_a(OH)_b(NO_3)_{1.52}(CO_3)_{0.48}.xH_2O$ | >30 days | No |
| I-36 | $Zr(O)_a(OH)_b(NO_3)_c(CO_3)_d.xH_2O$ | >30 days | Yes |
| C-19 | $Zr(OH)_4.xH_2O$ | 12 days | Yes |

The above results show that the anion stabilized, complex zirconium oxyhydroxide particulates employed in the invention provide considerable stability for a magenta ink jet dye when compared with the control materials. The data further show that the materials of the current invention are superior to "hydrous" zirconia, $Zr(OH)_4.xH_2O$, in imparting stability to ink jet dyes.

Example 3

Element 1

A coating composition was prepared from 72.0 wt. % of a 20 wt. % solids aqueous colloidal suspension of zirconia (oxy)hydroxides stabilized by nitrate (Zr100/20 purchased from Nyacol® Nano Technologies, Inc), 3.6 wt. % poly (vinyl alcohol) (PVA) (Airvol 203® from Air Products), and 24.4 wt. % water. (The relative proportion of zirconia to PVA is therefore 80/20 by weight). The solution was coated onto a base support comprised of a polyethylene resin coated photographic paper stock, which had been previously subjected to corona discharge treatment, using a calibrated coating knife, and dried to remove substantially all solvent components to form the ink receiving layer.

Element 2

This element was prepared the same as Element 1 except that the coating composition was 74.0 wt. % of an aqueous colloidal suspension of zirconium (oxy)hydroxide stabilized by acetate (20 wt. % from Alfa Aesar, 0.005–0.01 micron particles, powder X-ray diffraction analysis indicated that the suspension contained an amorphous particulate.), 2.2 wt. % poly(vinyl alcohol) (Gohsenol® GH-17 from Nippon Gohsei Co.), and 23.8 wt. % water. (The relative proportion of zirconia to PVA is therefore 87/13 by weight).

Comparative Element C-1

This element was prepared the same as Element 1 except that the coating composition was 53.3 wt. % of a fumed Zirconia (a 30 wt. % aqueous suspension from Degussa, lot # 007-80, ID # 1TM106, powder X-ray diffraction analysis indicated that the suspension contained a crystalline $ZrO_2$ particulates), 4.0 wt. % poly(vinyl alcohol) (Airvol 203® from Air Products), and 42.7 wt. % water. (The relative proportion of zirconia to PVA is therefore 80/20 by weight).

Comparative Element C-2

This element was prepared the same as Element 1 except that the coating composition was 60.0 wt. % of silica (a 40 wt. % aqueous colloidal suspension of Nalco2329® (75 nm silicon dioxide particles) from Nalco Chemical Co.), 6.0 wt. % poly(vinyl alcohol) (Airvol 203® from Air Products), and 34.0 wt. % water. (The relative proportion of silica to PVA is therefore 80/20 by weigh).

Comparative Element C-3

This element was prepared the same as Element 1 except that the coating composition was 60.0 wt. % of a fumed alumina solution (40 wt. % alumina in water, Cab-O-Sperse® PG003 from Cabot Corporation), 6.0 wt. % poly (vinyl alcohol) (Airvol 203® from Air Products), and 34.0 wt. % water. (The relative proportion of alumina to PVA is therefore 80/20 by weight).

Comparative Element C-4

This element was prepared the same as Element 1 except that the coating composition was 64.0 wt. % of silica (a 40 wt. % aqueous colloidal suspension of Nalco2329® (75 nm silicon dioxide particles) from Nalco Chemical Co.), 4.5 wt. % poly(vinyl alcohol) (Airvol 203® from Air Products), and 31.5 wt. % water. (The relative proportion of silica to PVA is therefore 85/15 by weight.

Comparative Element C-5

This element was prepared the same as Element 1 except that the coating composition was 31.9 wt. % of silica (a 40 wt. % aqueous colloidal suspension of Nalco2329® (75 nm silicon dioxide particles) from Nalco Chemical Co.), 2.25 wt. % poly(vinyl alcohol) (Gohsenol® GH-17 from Nippon Gohsei Co.), and 65.85 wt. % water. (The relative proportion of silica to PVA is therefore 85/15 by weight).

Printing and Dye Stability Testing

The above elements were printed using a Lexmark Z51 ink jet printer and a cyan ink jet ink, prepared using a standard formulation with a copper phthalocyanine dye (Clariant Direct Turquoise Blue FRL-SF), and a magenta ink, prepared using a standard formulation with Dye 6 from U.S. Pat. No. 6,001,161, as illustrated above. The red channel density (cyan) patches and green channel density (magenta) patches at D-max (the highest density setting) were read using an X-Rite® 820 densitometer. The printed elements were then subjected to 4 days exposure to a nitrogen flow containing 5 ppm ozone. The density of each patch was read after the exposure test using an X-Rite® 820 densitometer. The % dye retention was calculated as the ratio of the density after the exposure test to the density before the exposure test. The results for cyan and magenta D-max are reported in Table 3.

TABLE 3

| Element | Material | % dye retention magenta D-max | % dye retention cyan D-max |
|---|---|---|---|
| 1 | Amorphous $ZrO(OH)NO_3$ | 100 | 92 |
| 2 | Amorphous ZrO(OH)acetate | 96 | 100 |
| C-1 | Crystalline $ZrO_2$ | 14 | 68 |
| C-2 | Silica | 5 | 82 |
| C-3 | Alumina | 5 | 57 |
| C-4 | Silica | 3 | 64 |
| C-5 | alumina | 6 | 88 |

The above results show that with a porous layer containing particulate complex zirconium oxyhydroxides, dye stability towards environmental gases is excellent, however, with a porous layer comprising crystalline zirconia or fine-particle silica or fine particle alumina, dye stability towards environmental gases such as ozone remains poor.

Although the invention has been described in detail with reference to certain preferred embodiments for the purpose of illustration, it is to be understood that variations and modifications can be made by those skilled in the art without departing from the spirit and scope of the invention.

What is claimed is:

1. An ink jet recording element comprising a support having thereon a porous image-receiving layer comprising a polymeric binder, said porous image-receiving layer containing a metal(oxy)hydroxide complex coated in particulate form, $$M^{n+}(O)_{n(OH)b}(A^{p-})_c \bullet xH_2O,$$

wherein $M^{n+}$ is at least one metal ion and wherein M is a Group IVA or IVB metal of the periodic chart;

n is;

$A^{p-}$ is either an inorganic anion selected from the group consisting of $I^-$, $Cl^-$, $Br^-$, $F^-$, $ClO_4^-$, $NO_3^-$, $CO_3^{2-}$ and $SO_4^{2-}$ or $A^{p-}$ is an organic anion;

p is 1, 2 or 3; and x is equal to or greater than 0;

wherein a, b and c each comprise a rational number as follows: $0 \leqq a < 2$; $0 < b < 4$; and $0 < pc \leqq 4$, so that the charge of the $M^{4+}$ metal ion is balanced.

2. The recording element of claim 1 wherein M is tin, titanium, zirconium, silica, mixtures thereof.

3. The recording element of claim 1 wherein $A^{p-}$ is an organic anion selected from the group consisting of R—COO, R—O, R—$SO_3$; R—$OSO_3$ and R—O—$PO_3$ where R is an alkyl or aryl group.

4. The recording element of claim 1 wherein said metal (oxy)bydroxide complex is prepared from an aqueous dispersion having a pH between about 3 and 10.

5. The recording element of claim 1 wherein M is Zr.

6. The recording element of claim 5 wherein said complex is amorphous.

7. The recording element of claim 5 wherein $A^{p-}$ is $Cl^-$, $NO_3^-$, $CO_3^{7-}$, acetate or propionate.

8. The recording element of claim 1 wherein a,b and c each comprise a rational number as follows: $0 \leqq a < 1$; $1 < b < 4$; and $1 \leqq pc < 4$, so that the charge of the $M^4$ metal ion is balanced.

9. The recording clement of claim 1 wherein a is 0, n is 4, and b+pc is 4.

10. The recording element of claim 1 wherein the particle size of said complex is less than about 1 μm.

11. The recording element of claim 1 wherein the particle size of said complex is less than about 0.1 μm.

12. The recording element of claim 1 wherein said support is opaque.

13. The recording element of claim 1 wherein said support is transparent.

14. The recording element of claim 1 which also includes a base layer located between said image-receiving layer and said support.

15. An ink jet recording element comprising a support having thereon a porous image-receiving layer comprising a polymeric binder, said porous image-receiving layer containing a metal(oxy)hydroxide complex coated in particulate form, $$M^{n+}(O)_a(OH)_b(A^{p-})_c \bullet xH_2O,$$

wherein $M^{n+}$ is at least one metal ion and wherein M is a Group IVA or IVB metal of the periodic chart;

n is;

$A^{p-}$ is either an inorganic anion selected from the group consisting of I, CI, $Br^-$, $F^-$, $ClO_4^-$, $NO_3^-$, $CO_3^{2-}$ and $SO^{42-}$ or $A^{p-}$ is an organic anion;

p is 1, 2 or 3; and x is equal to or greater than 0;

wherein a, b and c each comprise a rational number as follows: $0 \leqq a < 2$; $0 < b < 4$; and $0 < pc \leqq 4$, so that the charge of the $M^{4+}$ metal ion is balanced;

wherein said porous image-receiving layer is a product of coating the metal(oxy)hydroxide complex as a colloidal dispersion of solid particulates prepared from an aqueous dispersion having a pH between about 3 and 10.

16. An ink jet recording element comprising a support having thereon a porous image-receiving layer comprising a polymeric binder, said porous image-receiving layer containing a metal(oxy)hydroxide complex coated in particulate form, $$M^{n+}(O)_a(OH)_b(A^{p-})_c \bullet xH_2O,$$

wherein

M is zirconium;

n is;

$A^{p-}$ is either an inorganic anion selected from the group consisting of $I^-$, $Cl^-$, $Br^-$, $F^-$, $ClO_4^-$, $NO_3^+$, $CO_3^{2-}$ and $SO_4^{2-}$ or $A^{p-}$ is an p is 1, 2 or 3; and x is equal to or greater than 0;

wherein a, b and c each comprise a rational number as follows: $0 \leqq a < 2$; $0 < b < 4$; and $0 < pc \leqq 4$, so that the charge of the $M^{4+}$ metal ion is balanced;

and wherein the hydroxy groups dominate the percentage of A ions.

* * * * *

UNITED STATES PATENT AND TRADEMARK OFFICE

CERTIFICATE OF CORRECTION

PATENT NO. : 7,105,215 B2
APPLICATION NO. : 10/180638
DATED : September 12, 2006
INVENTOR(S) : Sharma et al.

It is certified that error appears in the above-identified patent and that said Letters Patent is hereby corrected as shown below:

Cover Page of Patent:
After "(*) Notice: Subject to any disclaimer, the term of this patent is extended or adjusted under 35 U.S.C. 154(b) by 390 days." insert -- This patent is subject to a terminal disclaimer. -- .

Column 13, line 18, (Claim 1):
After "periodic chart;" delete "n is;" and insert -- n is 4; --.

Column 13, line 31 (Claim 3):
After "consisting of" delete "R-COO, R-O, R-$SO_3$; R-$OSO_3$ AND R-O-$PO_3$" and insert -- R-$COO^-$, R-$O^-$, R-$SO_3^-$; R-$OSO_3^-$ AND R-O-$PO_3^-$ --.

Column 13, line 34 (Claim 4):
After "said metal" delete "(oxy)bydroxide" and insert -- (oxy)hydroxide -- .

Column 13, line 43 (Claim 8):
After "charge of the" delete "$M^4$" and insert -- $M^{4+}$ --.

Column 14, line 17 (Claim 15):
After "periodic chart;" delete "n is;" and insert -- n is 4; --.

Column 14, line 19 (Claim 15):
After "consisting of" delete "I, CI" and insert -- $I^-$, $CI^-$ --.

Column 14, line 41 (Claim 16):
After "zirconium;" delete "n is;" and insert -- n is 4; --.

UNITED STATES PATENT AND TRADEMARK OFFICE

CERTIFICATE OF CORRECTION

PATENT NO. : 7,105,215 B2
APPLICATION NO. : 10/180638
DATED : September 12, 2006
INVENTOR(S) : Sharma et al.

It is certified that error appears in the above-identified patent and that said Letters Patent is hereby corrected as shown below:

Column 14, lines 42-43 (Claim 16):

After "consisting of" delete "$I^-$, $Cl^-$, $Br^-$, $F^-$, $ClO_4^-$, $NO_3^+$, $CO_3^{2-}$ and $SO_4^{2-}$ or $A^{p-}$ is an" and insert -- $I^-$, $Cl^-$, $Br^-$, $F^-$, $ClO_4^-$, $NO_3^-$, $CO_3^{2-}$ and $SO_4^{2-}$ of $A^{p-}$ is an organic anion --.

Signed and Sealed this

Twenty-sixth Day of December, 2006

JON W. DUDAS
*Director of the United States Patent and Trademark Office*